US008512067B2

(12) United States Patent
Denter et al.

(10) Patent No.: US 8,512,067 B2
(45) Date of Patent: Aug. 20, 2013

(54) CONNECTION AND SWITCHING CONTACT ELEMENTS FOR A TERMINATION STRIP FOR A TELECOMMUNICATIONS MODULE

(75) Inventors: Friedrich W. Denter, Castrop-Rauxel (DE); Christine B. Bund, Wuppertal (DE); Hans-Dieter Otto, Wipperfurth (DE); Wolfgang Edelmann, Wuppertal (DE); Guenter Szymanski, Wuppertal (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/376,425

(22) PCT Filed: May 28, 2010

(86) PCT No.: PCT/US2010/036525

§ 371 (c)(1),
(2), (4) Date: Dec. 6, 2011

(87) PCT Pub. No.: WO2010/147749

PCT Pub. Date: Dec. 23, 2010

(65) Prior Publication Data

US 2012/0077363 A1 Mar. 29, 2012

(30) Foreign Application Priority Data

Jun. 15, 2009 (GB) ..... 0910211.2
Jun. 15, 2009 (GB) ..... 0910216.1

(51) Int. Cl.
*H01R 4/24* (2006.01)

(52) U.S. Cl.
USPC ..... 439/403; 439/709

(58) Field of Classification Search
USPC ..... 439/403, 709
See application file for complete search history.

(56) References Cited

U.S. PATENT DOCUMENTS 4,283,105 A * 8/1981 Ferrill et al. ..... 439/406
4,618,204 A 10/1986 Saligny
4,641,903 A 2/1987 Anhalt et al.
5,549,489 A 8/1996 Baggett et al.
5,595,507 A 1/1997 Braun et al.

(Continued)

FOREIGN PATENT DOCUMENTS

AU 2006202891 A1 2/2007
CN 1206302 A 1/1999

(Continued)

*Primary Examiner* — Gary F. Paumen
(74) *Attorney, Agent, or Firm* — Gregg H. Rosenblatt

(57) ABSTRACT

A termination strip (1) for a telecommunications module comprising at least one pair of contact elements (50) arranged side-by-side, each terminating in contacts (13) on opposed longitudinal sides (9, 10) of the strip for connection to a wire pair of a telecommunications cable. Each contact element comprises: (i) two end regions (52) that terminate in contacts on respective longitudinal sides of the termination strip and are substantially aligned with one another along the longitudinal axis of the contact element, and (ii) a narrower central region (51) between the end regions, located substantially on one side of the longitudinal axis. One of the end regions comprises a resilient contact region (53) extending from the end region substantially on the other side of the longitudinal axis and engageable by an external component inserted into the termination strip from one of the opposed longitudinal sides. The contact elements are substantially identical but turned through 180° relative to one another with the narrower central regions adjacent one another.

9 Claims, 13 Drawing Sheets

(56) References Cited

U.S. PATENT DOCUMENTS

| | | | | |
|---|---|---|---|---|
| 5,722,850 | A | 3/1998 | White | |
| 5,800,215 | A | 9/1998 | Dohnke et al. | |
| 5,967,826 | A | 10/1999 | Letailleur | |
| 6,015,312 | A | 1/2000 | Escane | |
| 6,068,503 | A | 5/2000 | Gerke et al. | |
| 6,069,951 | A | 5/2000 | Dohnke | |
| 6,093,041 | A | 7/2000 | Kay et al. | |
| 6,247,974 | B1 * | 6/2001 | Jenner et al. | 439/746 |
| 2007/0082524 | A1 | 4/2007 | Barthes et al. | |

FOREIGN PATENT DOCUMENTS

| | | | |
|---|---|---|---|
| DE | 195 37 529 | C1 | 3/1997 |
| DE | 197 11 128 | C1 | 7/1998 |
| DE | 20 2008 007 545 | U1 | 9/2008 |
| DE | 10 2007 026 111 | A1 | 12/2008 |
| DE | 20 2008 005 934 | U1 | 7/2009 |
| EP | 0 645 938 | A1 | 3/1995 |
| EP | 1 246 317 | A1 | 10/2002 |
| EP | 1 744 404 | A1 | 1/2007 |
| FR | 2 286 520 | | 4/1976 |
| GB | 2343563 | A | 5/2000 |
| WO | WO 2006/132972 | A2 | 12/2006 |
| WO | WO 2008/024085 | A2 | 2/2008 |
| WO | WO 2008/148458 | A1 | 12/2008 |
| WO | WO 2009/046481 | A1 | 4/2009 |
| WO | WO 2010/147747 | A2 | 12/2010 |
| WO | WO 2010/147748 | A2 | 12/2010 |

* cited by examiner

CONNECTION AND SWITCHING CONTACT ELEMENTS FOR A TERMINATION STRIP FOR A TELECOMMUNICATIONS MODULE

CROSS REFERENCE TO RELATED APPLICATIONS

This application is a national stage filing under 35 U.S.C. 371 of PCT/US2010/036525, filed May 28, 2010, which claims priority to Great Britain Application No. 0910211.2, filed Jun. 15, 2009, and Great Britain Application No. 0910216.1, filed Jun. 15, 2009, the disclosure of which is incorporated by reference in its/their entirety herein.

The invention relates to termination strips for use in telecommunications modules at distribution points in telecommunications systems. The invention relates, in particular, to contact elements for use in termination strips.

BACKGROUND

In the field of telecommunications, numerous customers (also called subscribers) are connected with the exchange (also known as the switch) of a telecommunications company via telecommunications lines and modules. A telecommunications module establishes electrical connections between incoming wires and outgoing wires. A plurality of telecommunications modules can be assembled, possibly with other telecommunications components, at a distribution point, such as a main distribution frame located in the central office of a telecommunications company, an intermediate distribution frame, an outside cabinet which may serve several streets or houses, or a distribution point located, for example in an office building or on a particular floor of an office building. Some telecommunications lines may be permanently connected with first telecommunications modules, and so called "jumpers", which can be changed, are used to make non-permanent connections between electrical contacts in those first modules and electrical contacts in other modules.

Termination strips comprising a plurality of contact elements are used in telecommunications modules to establish electrical connections between incoming and outgoing wires in a telecommunications system, typically between the wires of system cables and the wires of jumper cables. A plurality of termination strips is typically assembled on a suitable carrier, for example a back-mount frame. Termination strips of various types are well known.

With the continuing expansion of telecommunications services, there is a growing need for telecommunications assemblies to be as compact as possible and, at the same time, for installation procedures to be simplified so that they can be carried out cost-effectively. In the case of termination strips comprising a plurality of contact elements with contacts to which incoming and outgoing wires are to be connected, it is known that a more compact arrangement can be achieved (thereby enabling the density of the connections that can be established in a limited space to be increased) if the connections between the wires and the contacts of the contact elements can be made at two opposed longitudinal sides of the strip rather than at only one side. Termination strips of that "double-sided" type offer the advantage that the incoming and outgoing wires can be separated to respective sides of the strip, enabling more efficient use to be made of whatever space is available. Termination strips of the "double-sided" type are described, for example, in U.S. Pat. Nos. 4,618,204 (Saligny), 5,549,489 (Baggett et al), 6,068,503 (Gerke et al), and 6,069,951 (Dohnke); AU 2006/202891 (Reichle & de Massari AG); EP-A-1 246 317 (3M Innovative Properties Company); GB-2 343 563 (Porta Systems Corporation); and WO 2006/132972 (Commscope Solutions Properties).

WO 2008/024085 (Turk Telekominikasyon A.S.) and WO 2009/046481 (ADC GmbH) both describe double-sided termination strips in which, with a view to utilizing available space more efficiently, the contact elements within the terminal strip are arranged in two opposed parallel rows.

Many different forms of contact elements are known for use in double-sided termination strips. They are of two types, referred to herein as "connection" contact elements and "disconnection" contact elements. Connection contact elements are one-piece elements that, in use, extend between the opposed longitudinal sides of the termination strip, where they typically terminate in insulation displacement contacts (IDCs). Examples of connection contacts are described in WO 2008/148458 (ADC Gmbh) and U.S. Pat. No. 5,800,215 (Dohnke), and the above-mentioned AU 2006/202891 and U.S. Pat. No. 4,618,204 (Saligny). Disconnection contacts also extend between the opposed longitudinal sides of the termination strip but are in two parts that resiliently engage one another at a disconnection point and can be disengaged to break the electrical connection between them by inserting a plug member into the termination strip from one of the longitudinal sides. Examples of disconnection contacts are described in the above-mentioned EP-A-1 246 317 and US 2007/082524 (Barthes and Metral).

The present invention is concerned with simplifying the provision of contact elements for use in double-sided termination strips and with enabling the provision of more compact telecommunications assemblies.

SUMMARY

The present invention provides a termination strip for a telecommunications module comprising at least one pair of contact elements arranged side-by-side, each terminating in contacts on opposed longitudinal sides of the strip for connection to a wire pair of a telecommunications cable, wherein each contact element comprises:

(i) two end regions that terminate in contacts on respective longitudinal sides of the termination strip and are substantially aligned with one another along the longitudinal axis of the contact element, and (ii) a central region between the end regions, the central region being located substantially on one side of the longitudinal axis;

wherein one of the end regions comprises a resilient contact region extending from the end region substantially on the other side of the longitudinal axis and engageable by an external component inserted into the termination strip from one of the opposed longitudinal sides:

the contact elements being substantially identical but turned through 180° relative to one another with the narrower central regions adjacent one another.

As described herein, the contact elements are identical but turned through 180° about a central axis perpendicular to the general plane of the contact elements.

The asymmetric positioning of the contact regions of the pair of contact elements can enable the space between the contact regions to be maximized, to improve cross-talk attenuation between different subscriber lines incoming to the termination strip.

In one aspect of the invention, the contact elements are connection contact elements. In this aspect, the end regions of each contact element are joined by the central region of the contact element. The central region of a contact element may be narrower than the end regions of the contact element. A contact element of that type can be formed from a generally-planar element of substantially constant width by removing or folding back a part of a central region of the element to reduce the width of that region. The folded-back part, when present, may form the resilient contact region of the contact element, offering manufacturing advantages and resulting in a contact element in which the contact region is bent out of the plane of an end region of the contact element. When formed in this way, the contact region need not increase the width of the contact element.

The pair of connection contact elements may be arranged in a termination strip as part of a single row of pairs of contact elements, or as part of one of two opposed rows of pairs of contact elements. In each case, particular manufacturing advantages are provided because only one form of contact element is required.

In an embodiment of the invention, the termination strip comprises two of said pairs of connection contact elements facing one another and turned through 180° relative to one another whereby the contact regions of both pairs are engageable by an external component inserted into the termination strip, between the facing pairs, from one of the opposed longitudinal sides.

As described herein, the pairs of contact elements are identical but turned through 180° about a longitudinal axis between the two contact elements of a pair.

In another aspect of the invention, the contact elements are switching contact elements. In this aspect, the central region of each contact element extends from the other of the end regions of the contact element towards the said one region without making contact with the latter and forms a second resilient contact region; both resilient contact regions being engageable by an external component inserted into the termination strip from one of the opposed longitudinal sides to establish an electrical connection between the end regions of the contact element.

Each switching contact element may be generally similar to a connection contact element of the first aspect of the invention, with the central region being bent out of the plane of the said one end region to form the respective resilient contact region, and the folded-back part forming the respective resilient contact region of the other end region. In that way, a switching contact element can be provided that, advantageously, occupies no more space than a connection contact element.

The pair of switching contact elements may be arranged in a termination strip as part of a single row of pairs of contact elements, or as part of one of two opposed rows of pairs of contact elements. In each case, particular manufacturing advantages are provided because only one form of contact element is required.

In an embodiment of this aspect of the invention, the termination strip comprises two of said pairs of switching contact elements facing one another and turned through 180° relative to one another, wherein the two end regions of the contact elements of both pairs can be electrically-connected with one another by an external component inserted into the termination strip, between the pairs, from one of the opposed longitudinal sides of the termination strip.

As described herein, the pairs of contact elements are identical but turned through 180° about a longitudinal axis between the two contact elements of a pair.

The invention provides contact elements that can be used in various orientations thereby enabling a termination strip to be provided using one type of contact element only. By using the one type of contact element in different orientations, the contact elements in the termination strip can be closely-spaced while maximizing the space between contact points within the strip. Contacts elements in accordance with the invention can be in the form of connection contacts. Alternatively, when they comprises two separate end regions, they can provide similar functions to those provided by disconnection contacts while occupying less space, thereby also assisting in the provision of more compact telecommunications assemblies.

The manufacturing advantages provided by the use of substantially identical contact elements can be further increased if the termination strip, including the mounting mechanisms, is symmetrical about a central axis extending between the ends of the strip enabling it to be assembled from two identical housing parts.

A telecommunications module may comprise a termination strip in accordance with the invention mounted on a carrier. The carrier may comprise a back-mount frame having a generally U-shaped cross-section, the termination strip being mounted on the free sides of the arms of the frame. The strip may be designed so that it can be mounted on the carrier in one orientation only with the contacts on one or other of the longitudinal sides of the strip accessible, thereby facilitating the placement of the strip on the carrier.

BRIEF DESCRIPTION OF THE DRAWINGS

By way of example only, termination strips for telecommunications systems will be described with reference to the accompanying drawings, in which.

DETAILED DESCRIPTION

Figure 1:
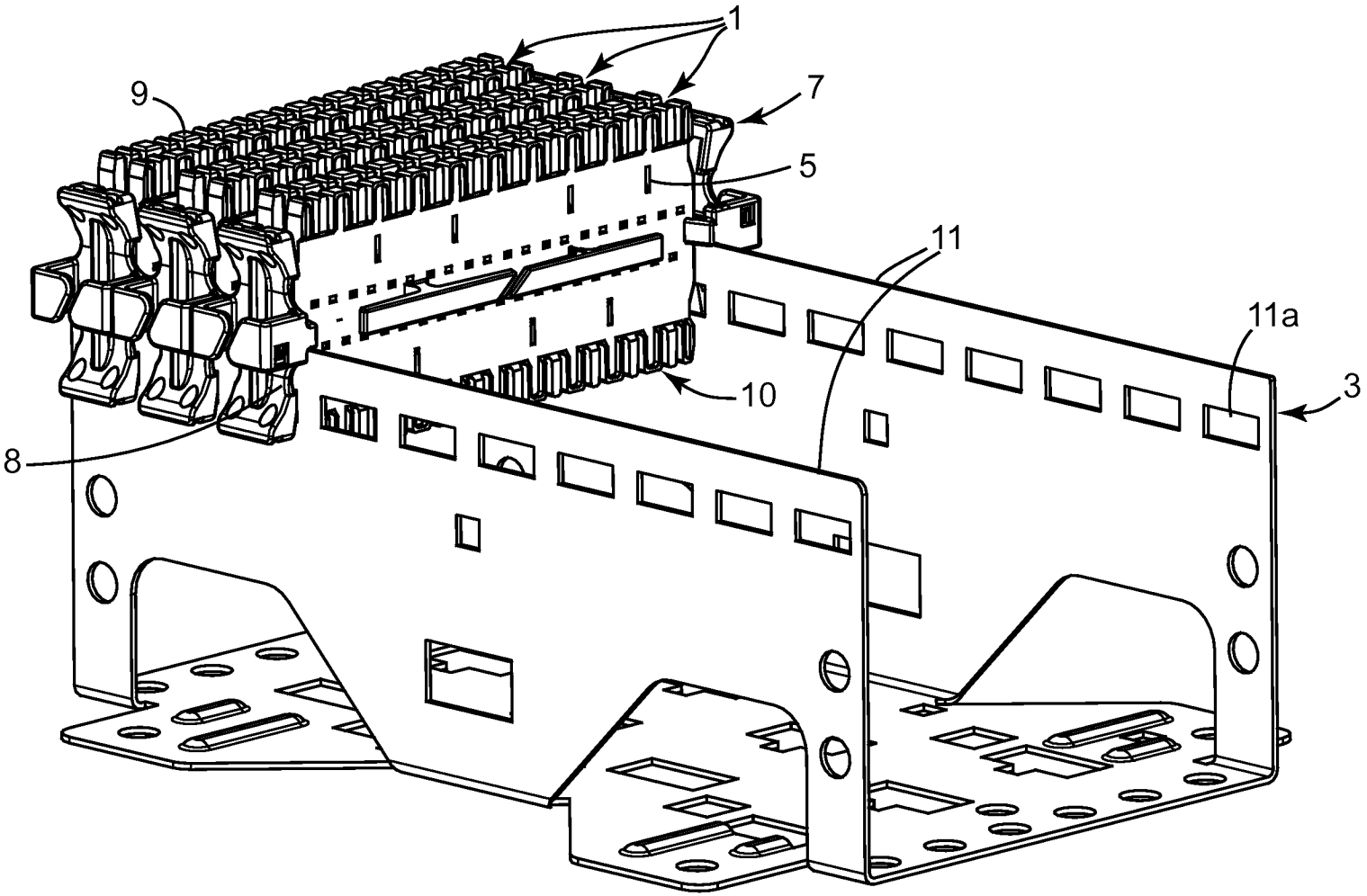
FIG. 1 is a perspective view of termination strips positioned on a carrier prior to the connection of incoming and outgoing wire pairs.
Figure 2:
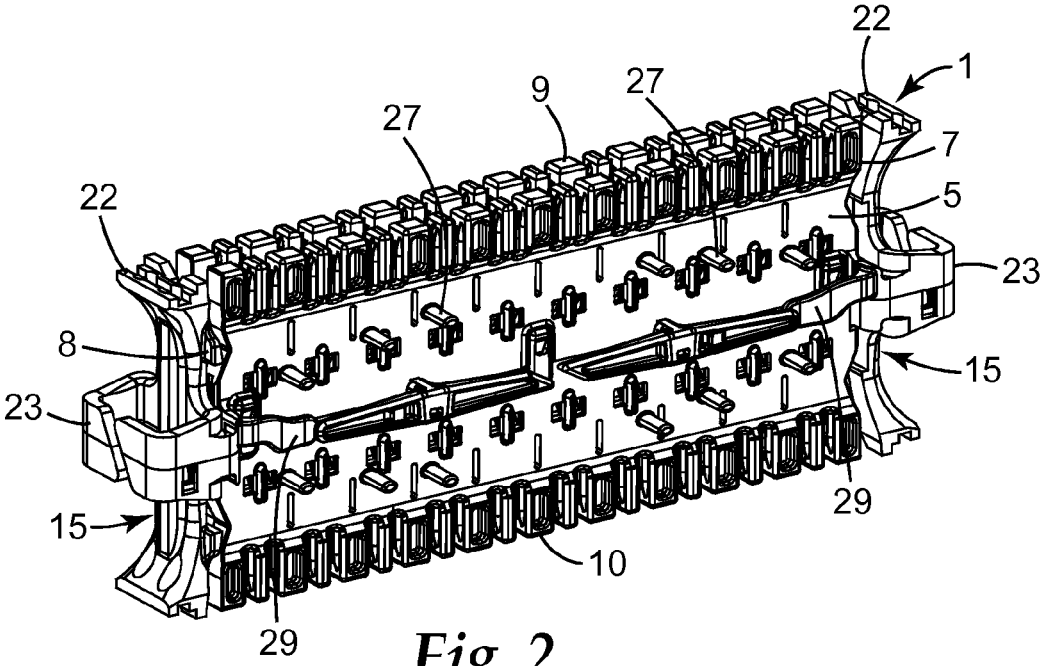
FIG. 2 is a perspective view of one of the termination strips of FIG. 1, removed from the carrier.
Figure 3:
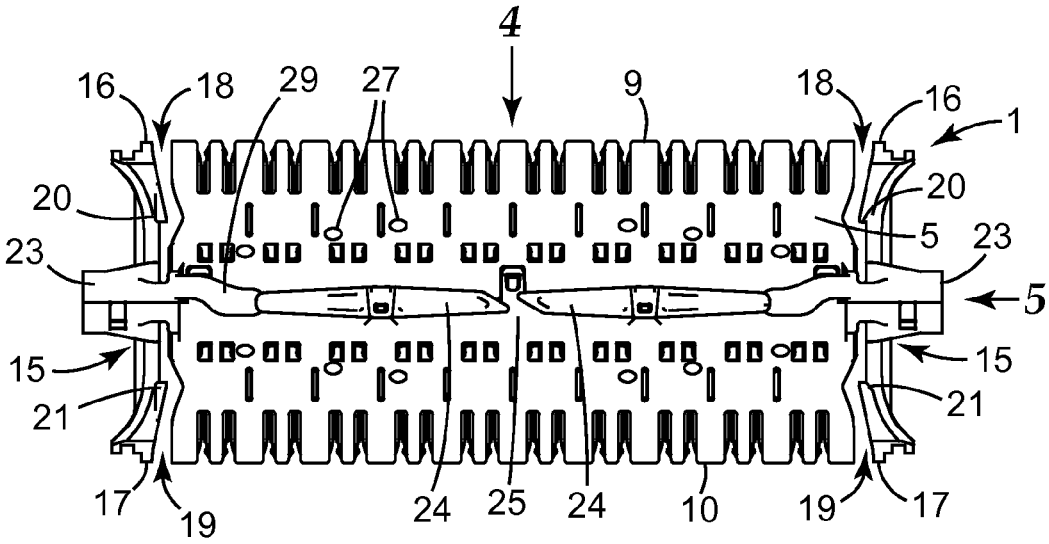
FIG. 3 shows one lateral face of the termination strip of FIG. 2.
Figure 4:
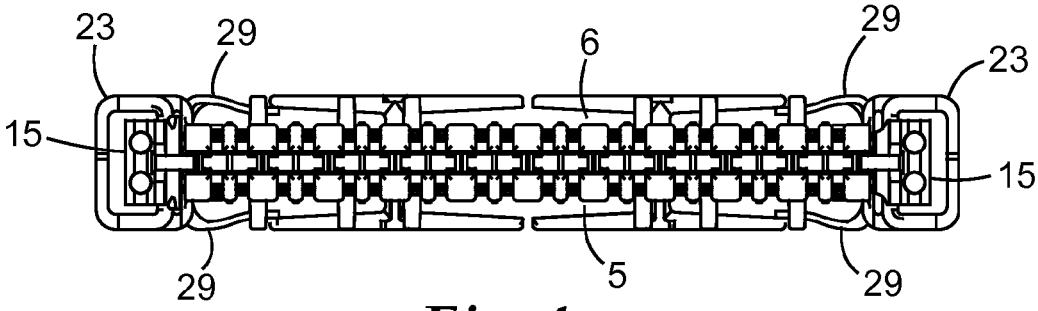
FIG. 4 is a view of one longitudinal side of the termination strip, in the direction of the arrow 4 in FIG. 3.
Figure 5:
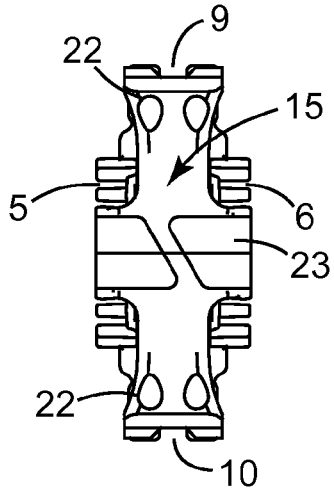
FIG. 5 is a view of one transverse side of the termination strip, in the direction of the arrow 5 in FIG. 3.

FIG. 1 shows termination strips 1 mounted on a carrier in the form of a back-mount frame 3. Although only three termination strips are shown, the back-mount frame as illustrated can accommodate ten such strips in total. Other back-mount frames or carriers may accommodate a different number of termination strips. Each termination strip has two opposed lateral faces 5, 6 (of which only the face 5 of one strip is visible in FIG. 1), opposed transverse sides 7, 8, and opposed longitudinal sides 9, 10. Within each termination strip 1, as described in greater detail below, are contact elements (not visible in FIG. 1) that connect incoming and outgoing wire pairs. The back-mount frame 3 is of a conventional type having a U-shaped cross section, on which the termination strips 1 can be mounted as shown, being supported at each end on the free edges 11 of the back-mount frame 3 with their lateral faces 5, 6 parallel to one another. As shown, a space is available between the termination strips 1 and the back of the frame 3 to accommodate cables comprising bundles of wire pairs to be connected to the termination strips.

Figure 6:
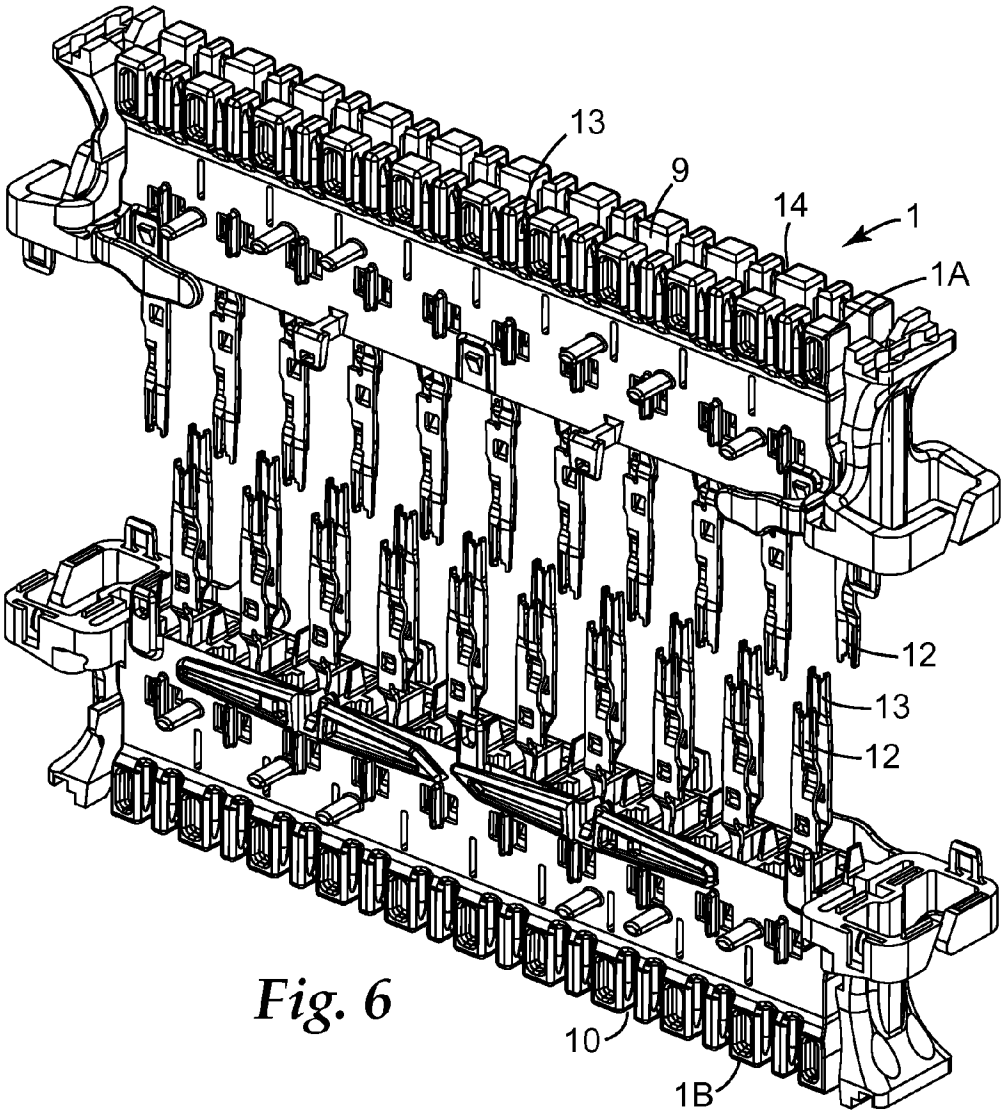
FIG. 6 is similar to FIG. 2 but shows the two halves of the termination strip separated to reveal the contact elements.

A termination strip 1 will now be described in greater detail with reference to FIGS. 2 to 6. The termination strip comprises two plastic housing parts 1A, 1B that meet along a central longitudinal plane parallel to the longitudinal sides 9, 10, where they are held together by suitably-located catches. The housing parts 1A, 1B are identical so that the completed housing is symmetrical about that central longitudinal plane. FIG. 6 shows the housing parts 1A, 1B separated to reveal the contact elements 12 within the termination strip, arranged side-by-side in two face-to-face rows. When the housing parts 1A, 1B are assembled, the contact elements 12 extend between the opposed longitudinal sides 9, 10 of the termination strip 1. Each contact element 12 has a conventional insulation-displacement contact (IDC) 13 at each end for connection, on one longitudinal side of the termination strip, to the conductor of a wire from a system cable of a telecommunications system and, on the other longitudinal side, to the conductor of a wire from a jumper cable. The IDCs 13, like the contact elements 12, are arranged side-by-side in two face-to-face rows and each has a slot associated with a respective push-in slot 14 in the body of the termination strip for the insertion in known manner of the line/jumper wire as the case may be, each pair of adjacent IDCs in a row being assigned to a respective subscriber wire pair. The contact elements 12 will not be described in detail at this point but may comprise the connection contact elements or switching contact elements described in greater detail below with reference to FIGS. 12 to 23.

The termination strip 1 is provided, at each end adjacent the transverse sides 7, 8, with a lever mechanism 15 for mounting the strip on the back-mount frame. Each lever mechanism 15 extends from the central area of the respective transverse side 7, 8 and comprises two arms 16, 17 directed respectively towards the front and the back of the termination strip. Each arm 16, 17 defines, with the adjacent transverse side of the termination strip, a respective slot 18, 19 into which an edge 11 of the back-mount frame 3 can be inserted depending on the orientation of the termination strip. Each arm 16, 17 further comprises a hook 20, 21 that projects into the adjacent slot and is intended to engage in an opening 11A adjacent the edge 11 of the back-mount frame to secure the termination strip in position. The outer end of each arm 16, 17 is formed as a grip 22 by which the arm can be pivoted to move the respective hook 20, 21 out of engagement with the opening 11A when it is required to remove the termination strip from the back-mount frame 3, and can also be used for mounting accessories such as labels.

A wire guide ring 23 projects outwardly from the central region of each lever mechanism 15, for use in the management of bundles of wire pairs that are being routed to the IDCs 13 of the termination strip 1 as described below.

The termination strip 1 is also provided, on each lateral face 5, 6, with two wire-guide arms 24 that extend parallel to the longitudinal axis of the face from the outer ends towards the centre, where they terminate with a small gap 25 between them into which bundles of wire pairs can be guided as described below. Each lateral face 5, 6 is additionally provided with wire retention/separation elements in the form of upstanding pegs 27, and with wire retention clips 29 that extend from the lever mechanisms 15 to resiliently engage under the end of the adjacent wire guide arm 24. Each wire retention clip 29 can be depressed to permit bundles of wire pairs to be pushed behind the adjacent wire guide arm 24 but will then re-engage with the arm to retain the wire pairs behind the guide arm.

In use, the termination strip 1 is used in the conventional manner to connect wire pairs from a system cable (for example a main cable or a distribution cable) to subscriber jumper wires. The wire pairs from the system cable are connected to the IDCs on one of the longitudinal sides 9, 10 of the termination strip, and the jumper wires are connected to the IDCs on the other longitudinal side. However, because the housing of the termination strip is symmetrical about the junction of the two housing parts 1A, 1B, there is no need for the installer to distinguish between those two sides of the termination strip prior to commencing the installation procedure: installation can commence with either of the two longitudinal sides 9, 10 facing out of the frame and no problems will be encountered in subsequently mounting any required accessories to the frame due to an incorrect initial orientation.

Figure 7A:
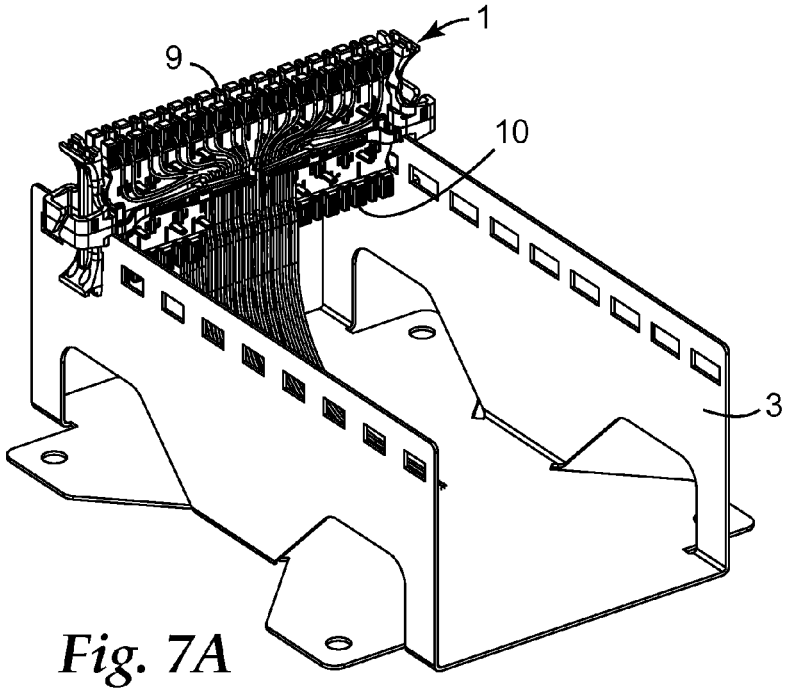
FIGS. 7A-7E illustrate various stages of one method for connecting wire pairs to the termination strip of FIGS. 1 to 6.

A method of installing the termination strip 1 in the back-mount frame 3 will now be described with reference to FIGS. 7A to 7E. It is assumed that the termination strip 1 has already been mounted on the back-mount frame 3 with the longitudinal side 9 facing out of the frame and that wire pairs from a system cable, located in the space between the termination strip and the back of the frame, have been fed out over each lateral face 5, 6 of the termination strip, passed underneath the wire guide arms 24 and connected to the IDCs 13 in the respective row on the longitudinal side 9 of the strip (FIG. 7A). The termination strip 1 then needs to be turned over so that the IDCs on its other longitudinal side 10 are accessible for the connection of wire pairs from a jumper cable also located in the space between the termination strip and the back of the back-mount frame 3.

Figure 7B:
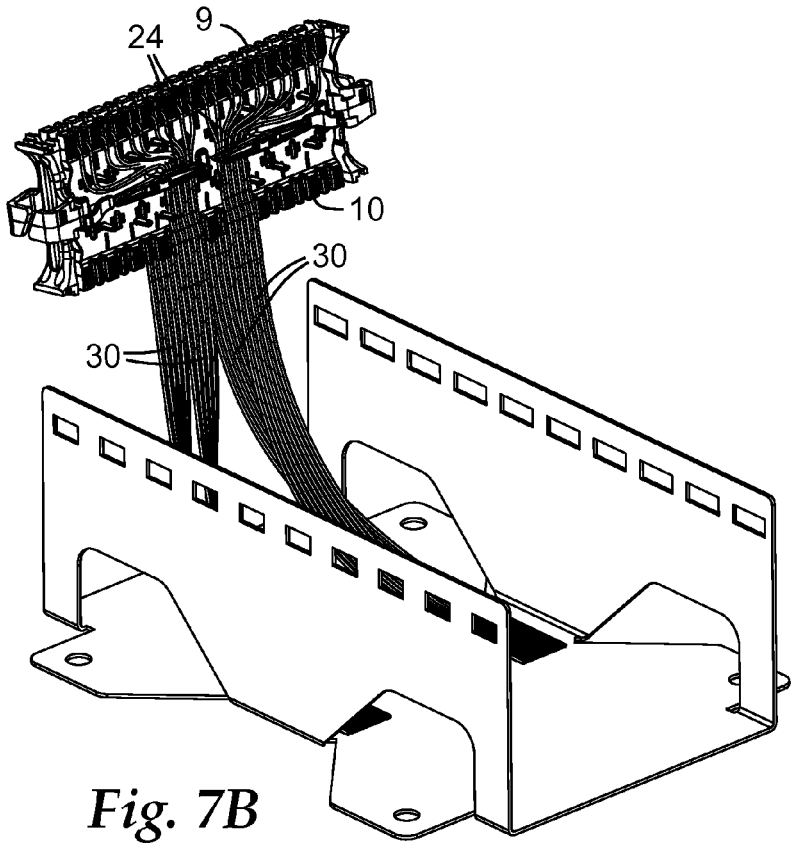
Figure 7C:
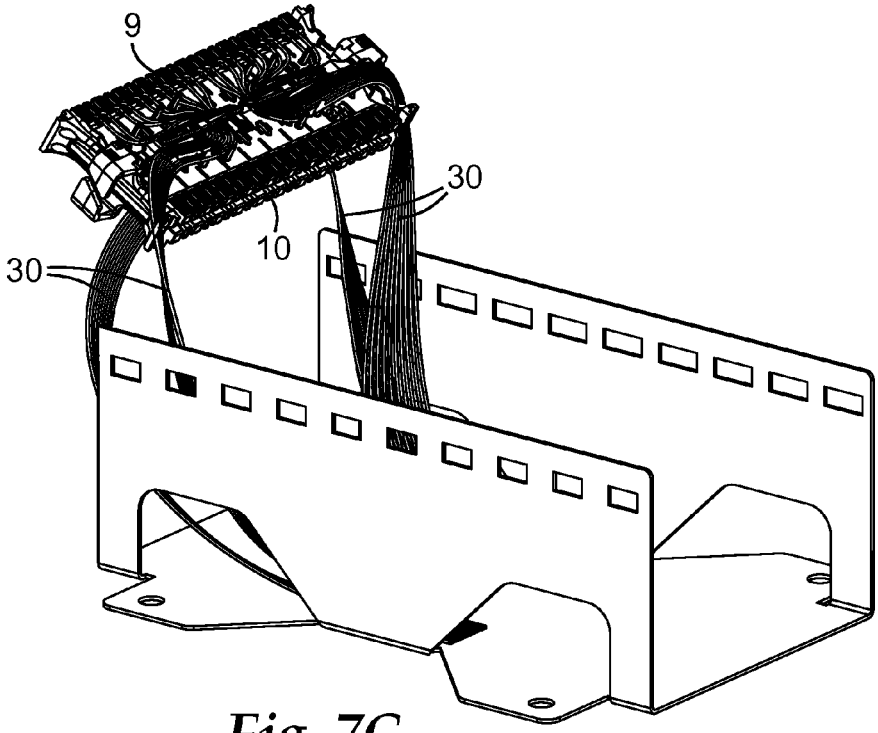
Figure 7D:
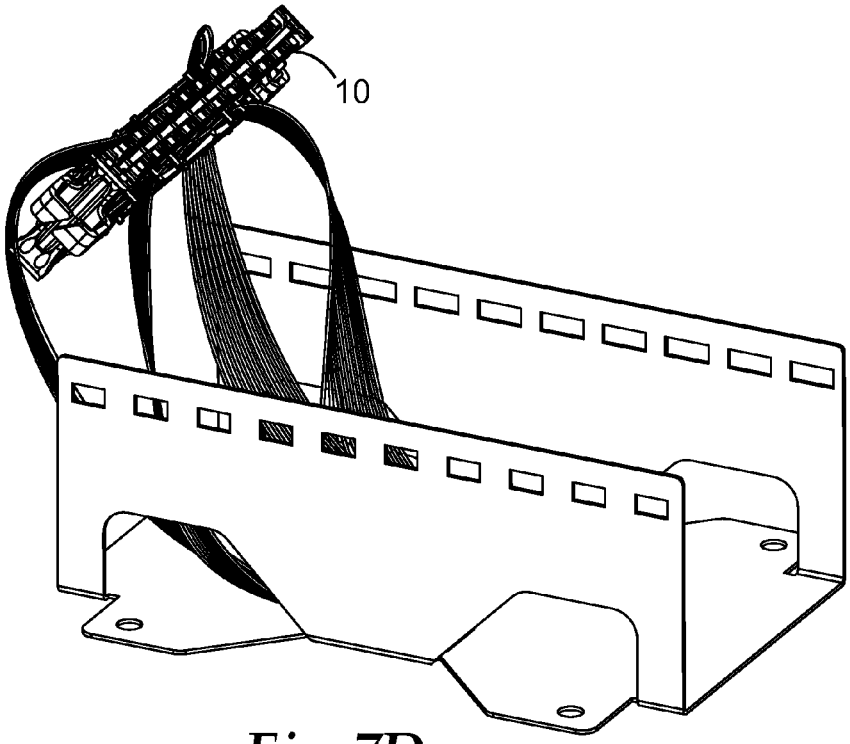

The termination strip 1 (with the connected wire pairs from the system cable) is first unlatched from, and lifted out of, the back-mount frame 3 (FIG. 7B). The wires on each lateral face 5, 6 are then separated into two bundles 30 (one behind each wire guide arm 24) and directed towards the respective ends of the termination strip (FIG. 7C). The termination strip 1 is now rotated through 180° on its longitudinal axis (i.e. a central axis extending between the lever mechanisms 15), between the separated wire bundles on each side of the strip, through the position shown in FIG. 7D. The wire bundles at each end of the termination strip can then be pushed behind the wire retention clips 29 to form the wire bundles into loops 31, and the termination strip is then replaced, in the new orientation, in the back-mount frame.

Figure 7E:
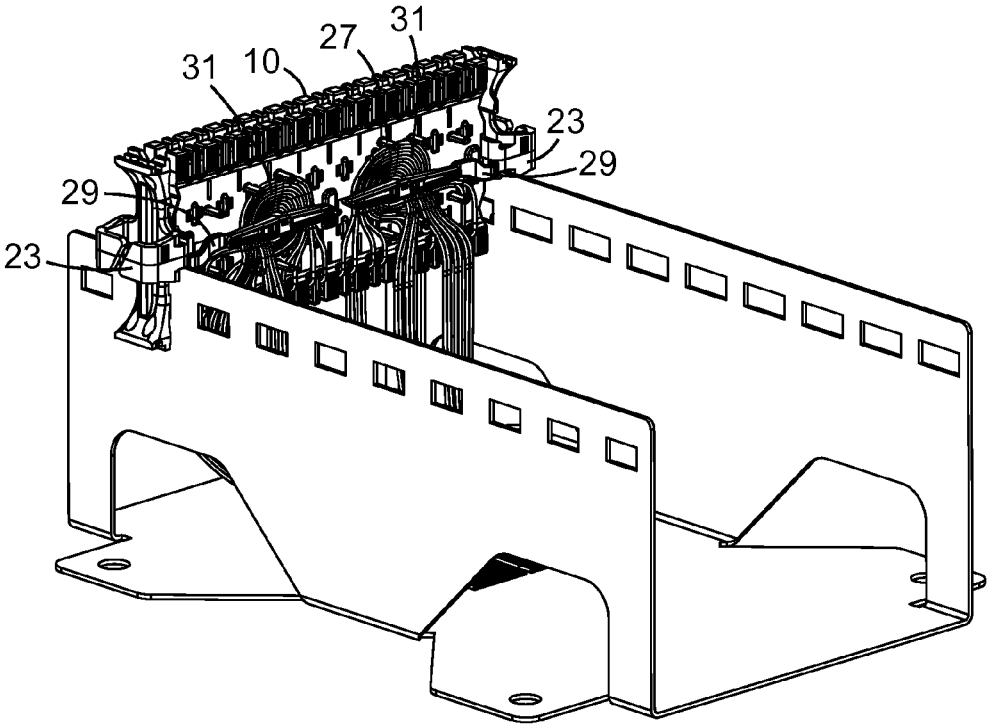

Each lateral face of the termination strip 1 now has the appearance shown in FIG. 7E. The shape of the loops 31 in the wire bundles 30 is determined by the upstanding pegs 27 on the lateral face 5, 6 of the termination strip, and by the wire retention clips 29 which prevent the loops extending beyond the ends of the strip.

The two rows of IDCs 13 on the longitudinal face 10 of the termination strip 1 are now accessible for the connection of wire pairs (not shown) from the jumper cable, which are fed to the IDCs through the wire guide rings 23 at both ends of the strip. The upstanding pegs 27 on the lateral faces 5, 6 of the termination strip, which are already functioning to restrict the loops 31 in the wire bundles 30, now also function to separate the jumper wires from those loops.

An advantage of rotating the termination strip 1 about its longitudinal axis for connecting the jumper wires is that it is easier to ensure that the system cable connections on one longitudinal side of the strip match the subscriber cable connections on the other longitudinal side of the strip. For example, if the termination strip has connections for twenty wire pairs of which ten (numbered 1 to 10 from one side of the back-mount frame) are along one side of the strip and ten (numbered 11 to 20 from the same side of the back-mount frame) are along the other side of the strip, the pairs 1 and 11 will remain at the same side of the back-mount frame after it has been rotated as described with reference to FIGS. 7A to 7E and, consequently, will be easier to locate. The advantage is achieved without using up long lengths of either the supply or jumper cable through the provision of the comparatively simple wire guide arms 24 on the lateral faces 5, 6 of the termination strip 1, which facilitate the separation of the wire pairs from the supply cable into the bundles 30 at the ends of the termination strip and, in turn, enable the strip to be rotated as described. The additional provision of the pegs 27 and the wire retention clips 29 on the lateral faces 5, 6 of the termination strip 1 limit the extent of the wire bundle loops 31 and ensure that the wired strip occupies no more space than the strip itself.

A further advantage achieved through the use of the method described above with reference to FIGS. 7A to 7E is that any pulling force on the system cable will have the effect of pulling each wire of the system cable further into the slot of the IDC 13 to which it is connected, thereby tending to secure rather than damage the connection. In view of that, the need for additional securing means such as covers on the termination strip may be eliminated.

It will be understood that the installation procedure described with reference to FIGS. 7A to 7E is not restricted for use only with a termination strip as shown in FIGS. 1 to 6 but is applicable to any termination strip having IDCs in two rows on both longitudinal sides of the strip.

It will also be appreciated that the wire-guide arms 24, the pegs 27 and the wire-retention clips 29 could be replaced by other features on the termination strip that perform the same function.

Figure 8A:
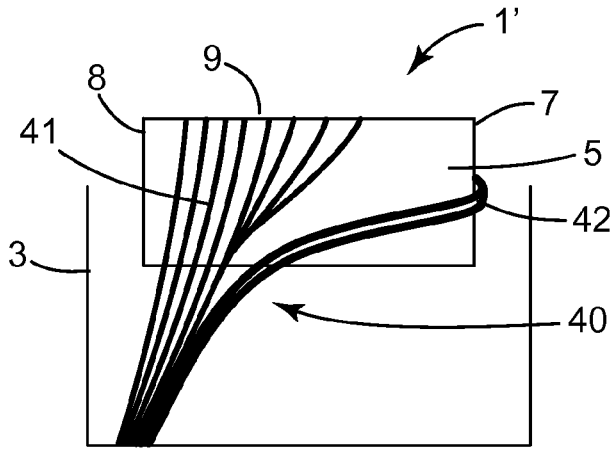
FIGS. 8A-8C illustrate various stages of another method for connecting wire pairs to the termination strip of FIGS. 1 to 6.
Figure 8B:
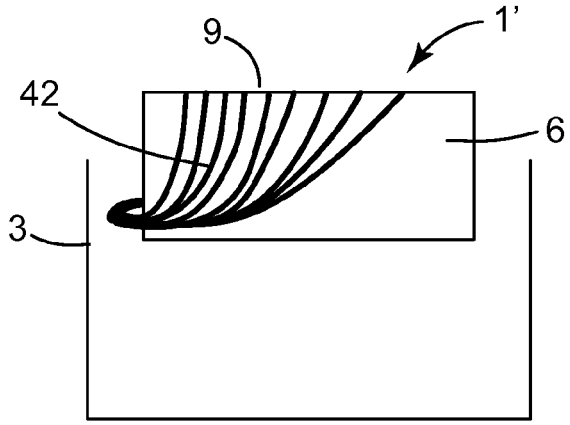
Figure 8C:
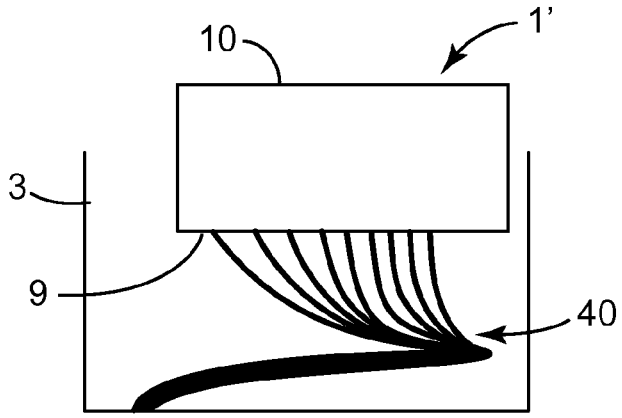

FIGS. 8A to 8C illustrate diagrammatically a method of installing a termination strip with two rows of contacts on both longitudinal sides, which also involves rotating the strip through 180° on its longitudinal axis but does not require the strip to be provided with the wire guide arms 24. In this case, with the termination strip 1' mounted on the back-mount frame 3, the bundle 40 of wire pairs from the system cable is pulled out of the space between the termination strip and the back of the back-mount frame across one of the lateral faces (face 5, say) of the strip. The wire bundle is divided in half and the wires in one half 41 are connected to the IDCs in the adjacent row on the forward-facing longitudinal side 9 of the termination strip 1', as illustrated in FIG. 8A. The other half 42 of the wire bundle is passed around the termination strip 1' to the other lateral face 6 and the wires in that half are connected to the IDCs in the other row on the longitudinal side 9 of the strip, as illustrated in FIG. 8B. Alternatively, if there are two 10-pair bundles rather than one 20-pair bundle, the wires of one bundle are connected to the IDCs in the row adjacent forward-facing longitudinal side 9 of the termination strip 1' and the wires in the other bundle are passed around the strip to the other lateral face 6.

The termination strip 1' (with the connected wire pairs from the system cable) is now unlatched from, and lifted out of, the back-mount frame 3 and rotated through 180° on its longitudinal axis (i.e. a central axis extending between the transverse sides 7, 8 of the strip) in a direction that would bring the longitudinal side 9 forwards out of the plane of the paper as seen in FIG. 8A. It is then replaced, in its new orientation, on the back-mount frame 3. The two rows of IDCs on the longitudinal face 10 of the termination strip l' are now accessible for the connection of wire pairs from the jumper cable, which may be fed to the IDCs through wire guide rings at both ends of the strip as described above with reference to FIG. 7B.

Following this installation method, both halves 41, 42 of the wire bundle 40 from the system cable can be arranged in the space between the termination strip 1' and the back of the back-mount frame 3, as shown in FIG. 8C. The half 42 of the wire bundle 40 is, of course, substantially longer than the other half 41 as a result of having been passed around the strip 1' in the initial stage of the method. The method does, however, (in common with that described above with reference to FIGS. 7A to 7D) have the advantageous result of making it easier to ensure that the system cable connections on one longitudinal side of the strip match the subscriber cable connections on the other longitudinal side of the strip.

Figure 9:
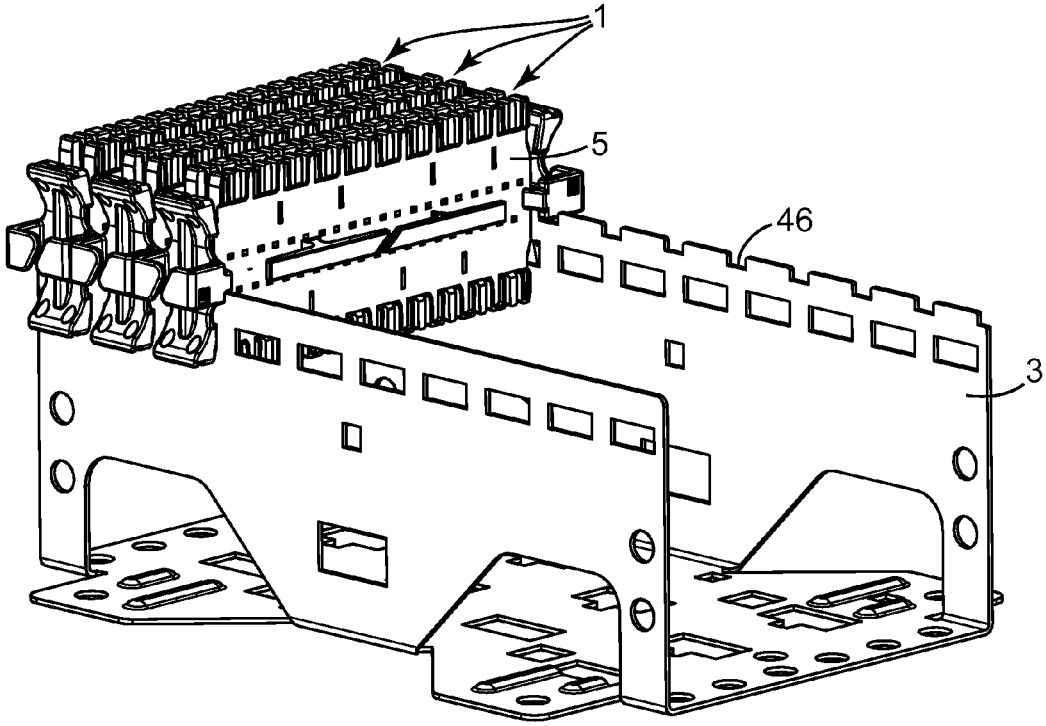
FIG. 9 is similar to FIG. 1 but shows a modification of the termination strips and the carrier.
Figure 10:
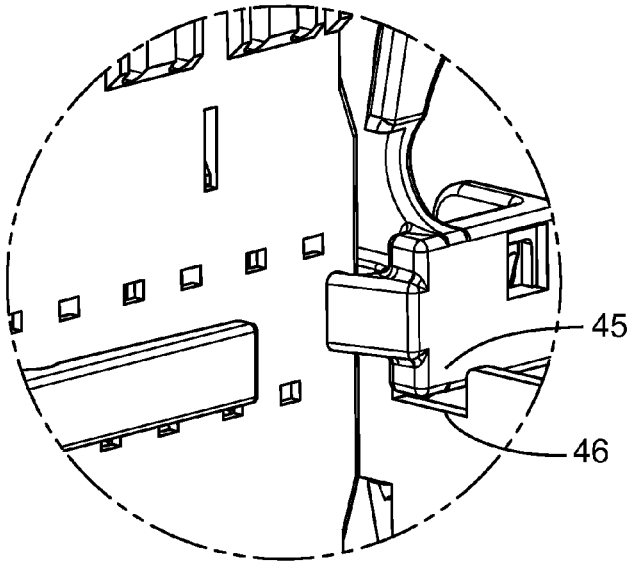
FIG. 10 is a detailed view of one end of one of the termination strips of FIG. 9, at the point at which it engages the carrier.

FIGS. 9 and 10 illustrate a modification of the termination strips 1 and back-mount frame 3 of FIG. 1, directed to ensuring that a termination strip cannot inadvertently be turned about a transverse axis during an installation procedure and mounted on the frame in the incorrect orientation (i.e. so that the lateral face 6 of the strip would be visible in FIG. 9 rather than the lateral face 5, with the attendant risk that the system cable connections on one longitudinal side of the strip may not match the subscriber cable connections on the other longitudinal side of the strip). To that end, in the termination strips 1 of FIG. 9, the lever mechanism 15 at one end of each of the strips (the right-hand end as seen in FIG. 9) is provided with an additional coding feature 45 (see also FIG. 10) that engages in a correspondingly-shaped cut-out 46 in the edge 11 of the respective side of the back-mount frame 3. The edge 11 of the other side of the back-mount frame 3 does not have the cut-outs 46, making it impossible for the lever mechanism 15 with the coding feature 45 to engage with that edge and, consequently, for the termination strip 1 to be mounted incorrectly on the back-mount frame. In that way, a substantial increase in efficiency can be obtained because the installation of termination strips can be carried out by less-skilled personnel without an increased risk of errors that could make it necessary to de-install the strips and re-install them again in the correct orientation (which could, in some cases, even require the system and/or jumper cable to be re-cut, leading to further difficulties if insufficient reserve cable is available).

Figure 11:
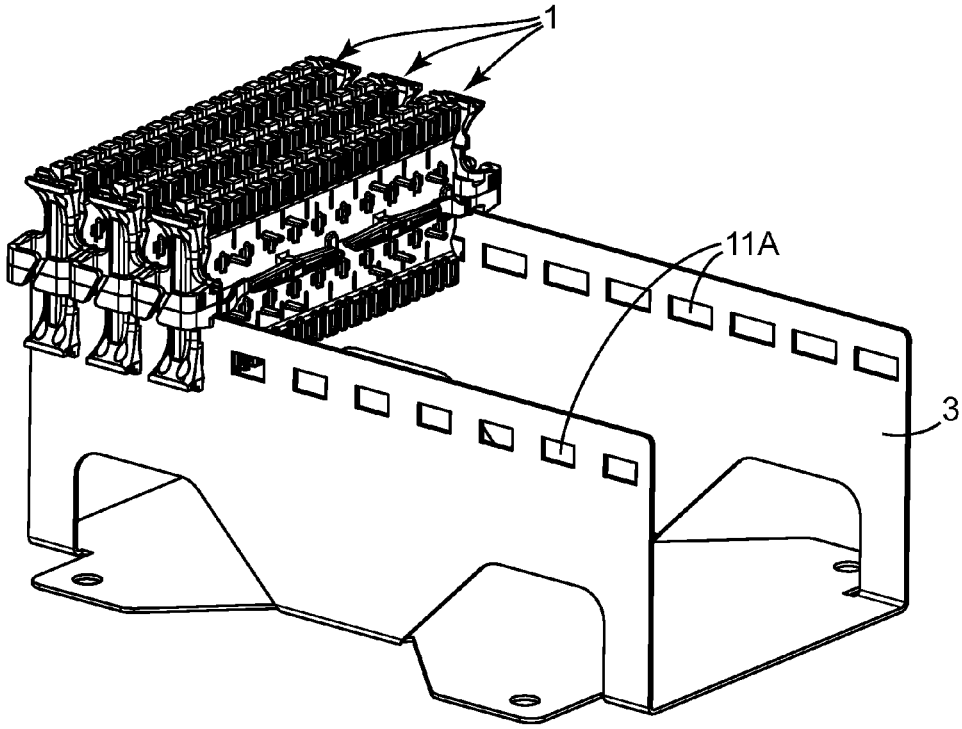
FIG. 11 is similar to FIG. 9 but shows a further modification of the termination strips and the carrier.

FIG. 11 shows an alternative modification of the termination strips 1 and back-mount frame 3 that serves a similar purpose to the modification just described with reference to FIGS. 9 and 10. In this case, the two sides of the back-mount frame are differentiated by the size of the openings 11A in which the hooks 20, 21 on the lever mechanisms 15 engage to mount the termination strips on the frame. Specifically, the openings 11A on one side of the back-mount frame (the right side as shown in FIG. 11) are larger than those on the other side of the frame, and the hooks 20, 21 (not visible in FIG. 11) on the lever mechanisms 15 of the terminations strips 1 are similarly-shaped with the result that it is impossible for the strips to be mounted incorrectly on the back-mount frame.

It will be understood that the modifications described with reference to FIGS. 9 to 11 could be applied to any combination of termination strip and back-mount frame when it is required to prevent the strip being mounted incorrectly on the frame. The modifications are, however, particularly applicable to termination strips that are otherwise symmetrical (and could, therefore, more easily be mounted in the wrong orientation on a back-mount frame), and to termination strips that have two rows of connections for wire pairs on two opposed sides of the strip (for which an incorrect orientation of the strip could give rise to mismatched wiring).

Contact elements suitable for use in the termination strips 1 will now be described with reference to FIGS. 12 to 23.

Figure 12:
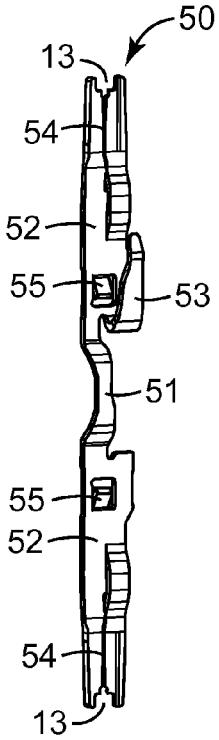
FIG. 12 is a perspective view of a connection contact element suitable for use in the termination strips of FIGS. 1, 9 and 11.
Figure 13:
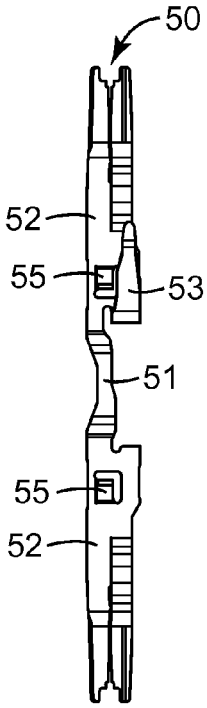
FIG. 13 is a plan view of the contact element of FIG. 12.
Figure 14:
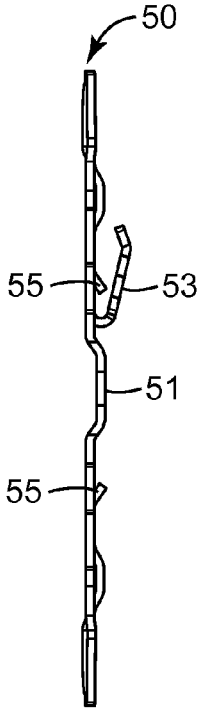
FIG. 14 is a side view of the contact element of FIG. 12.

FIGS. 12 to 14 show a connection contact element 50 i.e. one that provides a permanent connection between the IDCs 13 at the two ends of the element, which in use are accessible at the opposed longitudinal sides 9, 10 of the termination strip 1. The contact element 50 has a narrower central region 51 between its two end regions 52, formed by folding back the adjacent part 53 of the contact element towards one of those end regions. The narrower central region 51 of the contact element 50 thus lies substantially to one side of the longitudinal axis joining the wire-receiving slots 54 of the IDCs 13. The contact element is generally-planar, apart from the folded-back part 53, but is contoured in certain areas in known manner to ensure that it is securely-retained in its position in the housing of the termination strip 1 and to permit adjustment of the width of the slots in the IDCs 13. In addition, each end region 52 of the contact element comprises a catch 55 engageable in the respective housing part 1A, 1B of the termination strip to further secure the contact element in the housing.

Figure 15:
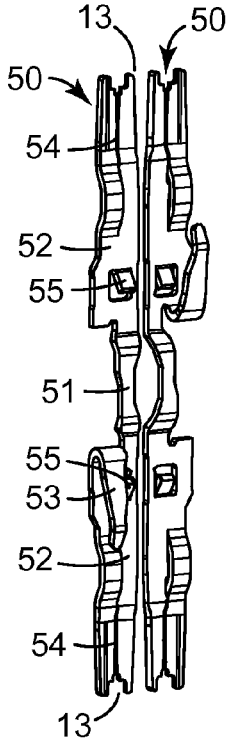
FIG. 15 is a perspective view of a pair of contact elements, each contact element being as shown in FIGS. 12 to 14.

FIG. 15 shows two of the contact elements 50 assembled side-by-side to receive a wire pair from a system cable at one end and a wire pair from a jumper cable at the other end. It can be seen from FIG. 15 that one of the contact elements 50 is rotated through 180° relative to the other about a central axis perpendicular to the plane of the element so that the narrower central regions 51 of the two contact elements lie adjacent one another and the folded-back parts 53 extend in opposite directions.

This pair of contact elements may be installed in a termination strip as part of a single row of pairs of contact elements. Alternatively, it may be installed in a termination strip as described above with reference to FIG. 1, 9 or 11 as part of one of two opposed rows of pairs of contact elements. In the latter case, the contact elements in the two rows may comprise opposed pairs of contact elements as shown in FIG. 16: it can be seen that the pairs of contact elements are identical, each being as shown in FIG. 15 but with one pair rotated through 180° relative to the other about a longitudinal axis (i.e. an axis parallel to the longitudinal axes of the contact elements) located between the two contact elements of the pair.

Figure 16:
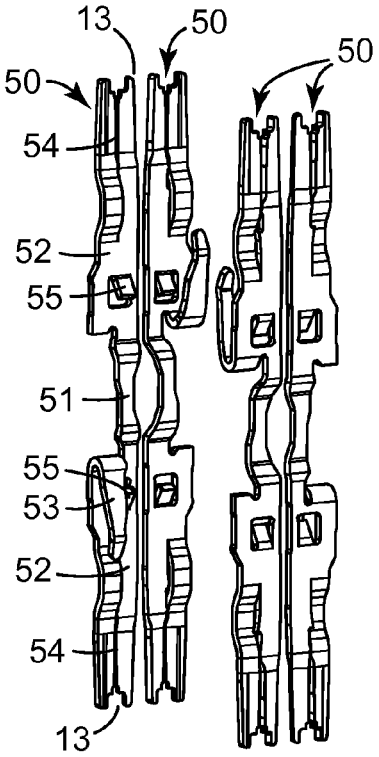
FIG. 16 is a perspective view of two opposed pairs of contact elements, each pair being as shown in FIG. 15.

In use of the contact pairs of FIGS. 15 and 16, the folded-back parts 53 of the contact elements 50 form resilient contact regions (i.e. contact springs) that extend from respective end regions 52 of the contact elements and can be engaged by a third element (for example a printed circuit board (PCB), an over-voltage protector (OVP), or a test plug) inserted into a termination strip for tapping a signal in a known manner. The asymmetric positioning of the contact springs 53 maximizes the spacing between the contact springs for the particular shape of contact element, which is known to enable better cross-talk attenuation between different subscriber lines to be achieved. The asymmetric positioning of the contact springs 53 is, moreover, achieved within the width of the end regions 52 of the contact elements (i.e. without any increase in the width of any of the contact elements), enabling the spacing of the pairs of contact elements along a row to be minimized. The contact elements 50 offer the further advantage that the configurations of both FIGS. 15 and 16 can be provided with a single design of contact element.

If necessary, the narrower central regions 51 of the contact elements 50 can be contoured (for example, as shown) to provide a certain minimum spacing in that region between adjacent contact elements of a pair. That may be necessary if, for example, the plastic material of the housing parts 1A, 1B of the termination strip (which normally serves to isolate the contact elements from one another) is not present in that region.

Figure 17:
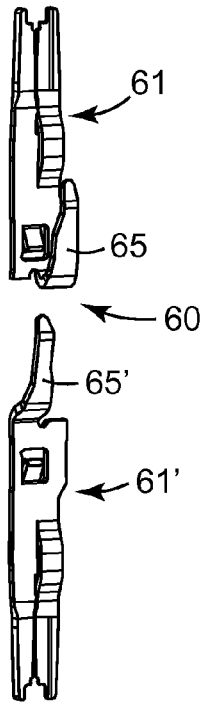
FIG. 17 is a perspective view of a switching contact element suitable for use in the termination strips of FIGS. 1, 9 and 11.
Figure 18:
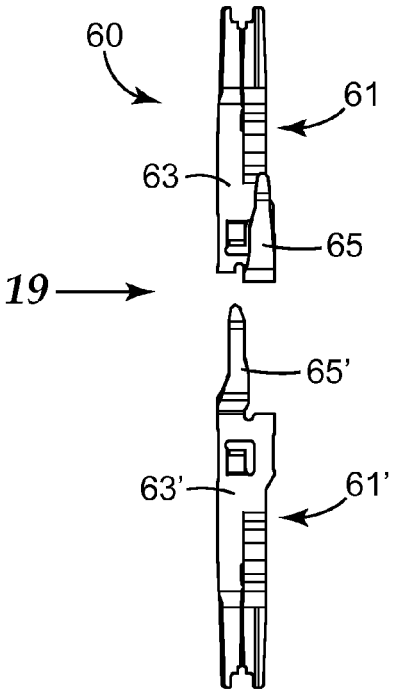
FIG. 18 is a plan view of the contact element of FIG. 17.
Figure 19:
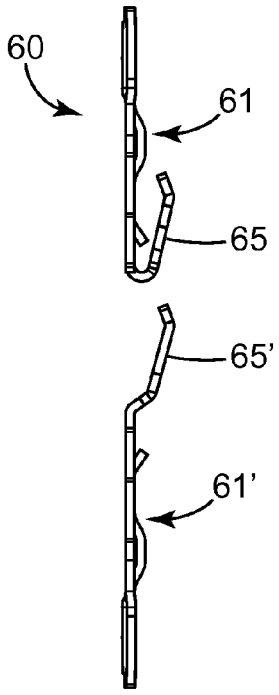
FIG. 19 is a side view of the contact element in the direction of the arrow 19 in FIG. 18.

FIGS. 17 to 19 show a switching contact element 60 i.e. one that provides a switchable connection between the IDCs 13 at the two ends of the contact element. The contact element is in two parts 61, 61': the part 61 comprises an end region 63 and a contact spring 65 (corresponding effectively to one end region 52 with the contact spring 53 of the contact element 50); and the part 61' comprises an end region 63' and a contact spring 65' (corresponding effectively to one end region 52 with the narrower central region 51 of the contact element 50). In this case, the contact spring 65' (corresponding to the central region 51 of contact element 50) extends towards, but does not make contact with, the end region 63 and is bent out of the plane of the end region 63' from which it extends.

Figure 20:
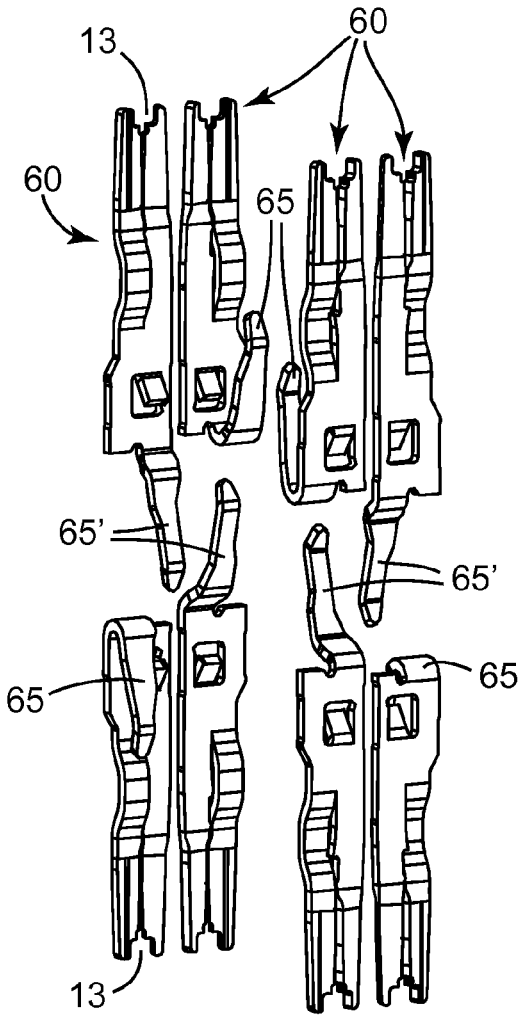
FIG. 20 is similar to FIG. 16 except that the contact elements are as in FIGS. 17 to 19.
Figure 21:
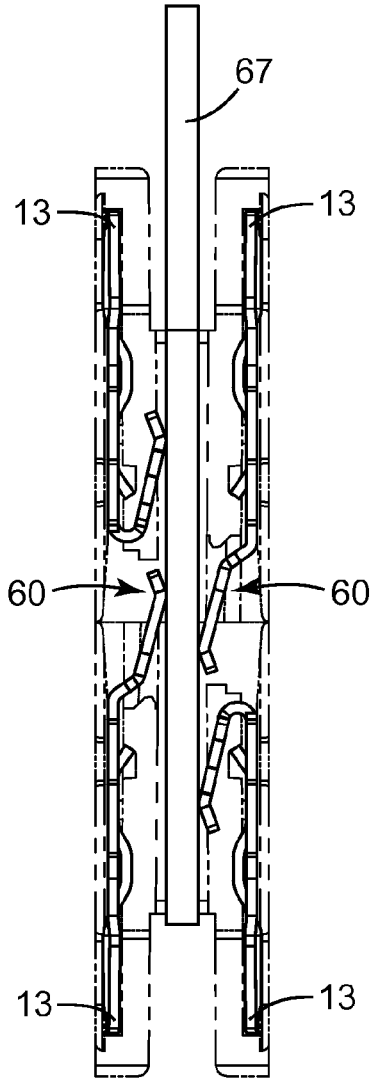
FIG. 21 is a side view of the contact elements of FIG. 20 in combination with a bridging element.

FIG. 20 shows how the contact elements 60 can be assembled in a termination strip side-by-side in pairs and in opposed pairs as described above with reference to FIGS. 15 and 16 for the connection contact elements 50. In this case, however, there is no connection between the IDCs 13 at the ends of the contact elements unless the contact springs 65, 65' are engaged by a third element (for example a bridging plug, a PCB, or an OVP) inserted into the termination strip to complete the connection. FIG. 21 shows, for example, such a connecting element 67 inserted between an opposed pair of contact elements 60 to complete the connections between the IDCs 13 at the ends of all four contact elements.

It can be seen by comparing FIGS. 14 and 19 that the switching contact element 60 will occupy no more space between the lateral faces 5, 6 of the termination strip 1 than the connection contact element 50. In that respect, having regard to the functionality that it provides, it offers an advantage (when space is at a premium) over conventional disconnection contact elements that typically require more space than connection contact elements.

Figure 22A:
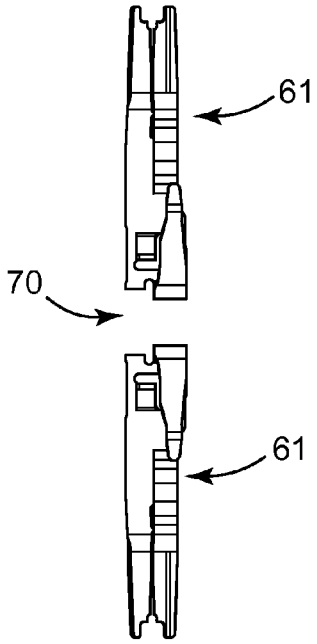
FIGS. 22A and B are plan and side views of an alternative switching contact element.
Figure 22B:
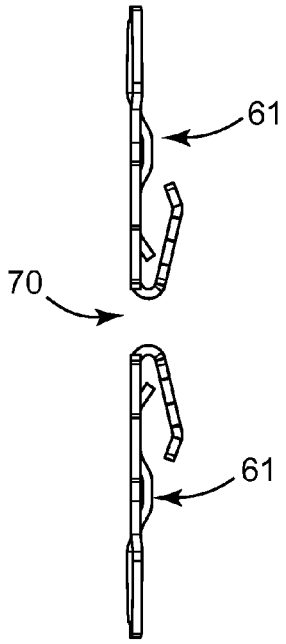
Figure 23A:
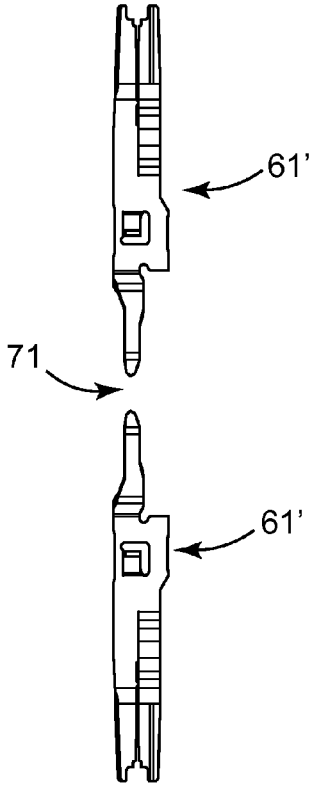
FIGS. 23A and B are plan and side views of another alternative switching contact element.
Figure 23B:
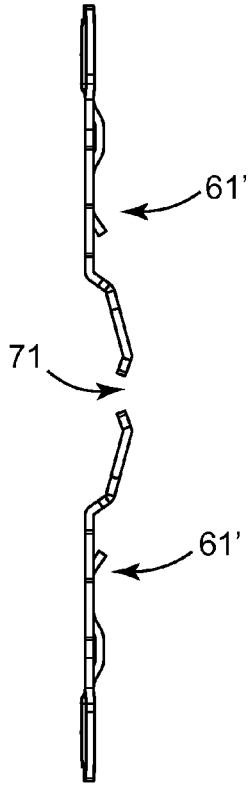

FIGS. 22 and 23 show how other forms of switching contact elements 70, 71 can be configured using, in FIGS. 22A and B, two parts similar to the part 61 of the contact element 60 and, in FIGS. 23A and B, two parts similar to the part 61' of the contact element 60.

It will be appreciated that the contact elements described with reference to FIGS. 12 to 23 can be used in terminations strips of a different form to that described above with reference to FIGS. 1 to 6. Likewise the termination strip described with reference to FIGS. 1 to 6 can employ contact elements of a different form to that described with reference to FIGS. 12 to 23. However, the combination of the described termination strip and the described contact elements offers particular manufacturing advantages resulting from the use of identical housing parts in the termination strip, and a standard form of contact element.

The termination strip described above is also described and claimed in our co-pending Patent Application Nos. GB 0910188.2, GB 0910192.4, and GB 0910199.9.

What is claimed is:

1. A termination strip for a telecommunications module comprising at least one pair of contact elements arranged side-by-side, each terminating in contacts on opposed longitudinal sides of the strip for connection to a wire pair of a telecommunications cable, wherein each contact element comprises:

(i) two end regions that terminate in contacts on respective longitudinal sides of the termination strip and are substantially aligned with one another along the longitudinal axis of the contact element, and (ii) a central region between the end regions, the central region being located substantially on one side of the longitudinal axis;

wherein one of the end regions comprises a resilient contact region extending from the end region substantially on the other side of the longitudinal axis and engageable by an external component inserted into the termination strip from one of the opposed longitudinal sides:

the contact elements being substantially identical but turned through 180° relative to one another with the central regions adjacent one another, in which the central region of each contact element extends from the other of the end regions of the contact element towards the said one region without making contact with the latter and forms a second resilient contact region; both resilient contact regions being engageable by an external component inserted into the termination strip from one of the opposed longitudinal sides to establish an electrical connection between the end regions of the contact element.

2. A termination strip as claimed in claim 1, in which the end regions of each contact element are joined by the central region of the contact element.

3. A termination strip as claimed in claim 2, in which the central region of each contact element is narrower than the end regions of the contact element.

4. A termination strip as claimed in claim 3, in which the contact region of each contact element is bent out of the plane of the respective end region of the contact element.

5. A termination strip as claimed in claim 3, comprising two of said pairs of contact elements facing one another and turned through 180° relative to one another whereby the contact regions of both pairs are engageable by an external component inserted into the termination strip, between the facing pairs, from one of the opposed longitudinal sides.

6. A termination strip as claimed in claim 5, in which the external component comprises a protection plug or a test device.

7. A termination strip as claimed in claim 1, in which each contact region is bent out of the plane of the respective end region of the contact element.

8. A termination strip as claimed in claim 1, comprising two of said pairs of contact elements facing one another and turned through 180° relative to one another, wherein the two end regions of the contact elements of both pairs can be electrically-connected with one another by an external component inserted into the termination strip, between the pairs, from one of the opposed longitudinal sides of the termination strip.

9. A termination strip as claimed in claim 1, in which the external component comprises a bridging plug, a protection plug or a test device.

* * * * *